United States Patent [19]

Mullay

[11] 4,439,254

[45] Mar. 27, 1984

[54] SOLID SENSITIZERS IN WATER GEL EXPLOSIVES AND METHOD

[75] Inventor: John J. Mullay, Hazelton, Pa.

[73] Assignee: Atlas Powder Company, Dallas, Tex.

[21] Appl. No.: 365,788

[22] Filed: Apr. 5, 1982

[51] Int. Cl.[3] ..... C06B 45/00

[52] U.S. Cl. ..... 149/2; 149/21; 149/41; 149/43; 149/44; 149/60; 149/62; 149/76; 149/83; 149/85; 149/92; 149/110; 149/114

[58] Field of Search ..... 149/2, 21, 41, 43, 44, 149/60, 62, 76, 83, 85, 92, 110, 114

[56] References Cited

U.S. PATENT DOCUMENTS

| | | | |
|---|---|---|---|
| 2,132,996 | 10/1938 | Palmieri | 52/2 |
| 3,129,126 | 4/1964 | Carlevato | 149/29 |
| 3,390,032 | 6/1968 | Albert | 149/45 |
| 3,409,486 | 11/1968 | Partridge | 149/21 |
| 3,465,675 | 9/1969 | Bronstein, Jr. | 102/23 |
| 3,617,404 | 2/1969 | Lyerly | 149/29 |
| 3,728,175 | 4/1973 | Craig | 149/29 |
| 3,734,864 | 5/1973 | Craig | 252/315 |
| 3,765,964 | 10/1973 | Wade | 149/2 |
| 3,784,421 | 1/1974 | Craig | 149/29 |
| 3,899,374 | 8/1975 | Sylkhouse | 149/2 |
| 3,919,015 | 11/1975 | Bolza | 149/44 |
| 4,033,264 | 7/1977 | Bolza et al. | 149/61 X |
| 4,077,820 | 3/1978 | Bolza et al. | 149/60 X |
| 4,104,092 | 8/1978 | Mullay | 149/2 |
| 4,140,561 | 2/1979 | Keith et al. | 149/85 X |
| 4,287,010 | 9/1981 | Owen | 149/2 |
| 4,343,663 | 8/1982 | Breza et al. | 149/61 X |
| 4,380,482 | 4/1983 | Sandell | 149/36 X |

*Primary Examiner*—Stephen J. Lechert, Jr.

*Attorney, Agent, or Firm*—Richards, Harris & Medlock

[57] ABSTRACT

A sensitizing agent for water gel explosive compositions and process for preparing the same is provided which comprises an oxidizer, water, a gelling agent, and a cross-linker, and wherein the improvement comprises including therein a sensitizer comprised of from about 1 to about 15 weight percent of aluminum admixed with from about 2 to about 25 weight percent of a densifying agent, such as ferrophosphorus, ferromanganese, ferrosilicon, or combinations thereof, said weight percentages being based on the total weight of the composition.

30 Claims, No Drawings

SOLID SENSITIZERS IN WATER GEL EXPLOSIVES AND METHOD

BACKGROUND OF THE INVENTION

1. Field of the Invention

The present invention relates to water gel explosive compositions and particularly to incorporating therewith a sensitizing amount of a sensitizing agent which comprises aluminum admixed with densifying agents, such as ferrophosphorus and other ferro-materials. In another aspect, the subject invention relates to a novel composition and method to increase the air gap sensitivity and low temperature detonability of water gel explosive compositions. In still a further aspect, the invention relates to a water gel explosive composition sensitized with a sensitizing agent formed by the mixing of aluminum with densifying agents prior to incorporation of the sensitizing agent so formed with the other components of the water gel explosive.

2. Background Art

Water gel explosives have become quite important in the blasting industry. Water gel explosive compositions are well known and generally comprise an oxygen-supplying salt, water which acts as a solvent or carrier for the salt, sensitizers and a thickener, such as guar gum. Additional components which can be utilized include a cross-linker such as sodium dichromate, potassium dichromate or zinc chromate, a fuel which may be water-soluble or water-insoluble, explosive or nonexplosive fuel and auxiliary sensitizers. Insoluble fuels include finely divided ferrophosphorus, sulfur, or carbonaceous material. Soluble fuels include glycol, diethylene glycol, dioxane, diethylene glycol monoethyl ether sucrose, urea or thiourea.

One problem that continues to face the industry is the production of high density, small diameter, water gel explosive compositions with reliable detonation characteristics. Prior attempts to solve this problem have required the use of high concentrations of expensive ingredients such as sodium perchlorate as illustrated by U.S. Pat. No. 3,765,967, issued to Funk, et al. on Oct. 16, 1973 and entitled "Liquid and Slurry Explosives of Controlled High Sensitivity." Metal fuels such as paint grade aluminum, finely divided magnesium, ferrophosphorus, and ferrosilicon may be added to increase the heat generation, and strength of water gel explosive compositions as disclosed in U.S. Pat. No. 3,129,126, issued to Carlevato on Apr. 14, 1964 and entitled "Blasting Composition"; U.S. Pat. No. 3,617,404, issued to Lyerly on Nov. 2, 1971 and entitled "Slurry Explosives Containing the Combination of Nitrogen - Base Salt and Hard Solid Particles as Sensitizer"; U.S. Pat. No. 3,728,175, issued to Craig on Apr. 17, 1973 and entitled "Slurry Explosives"; and U.S. Pat. No. 3,784,421, issued to Craig on Jan. 8, 1974 and entitled "Slurry Explosives Crosslinked With a Compound of Tellurium VI." Metallic phosphides such as manganese phosphide and iron phosphide have been added to priming compounds to vary their speed and sensitivity, as disclosed in U.S. Pat. No. 2,132,996, issued to Palmieri on Oct. 11, 1938 and entitled "Ignition and Priming Compound".

In order to better tailor water gel explosive compositions to conditions at the blasting site, such as diameter of the blasting hole and water content of the blasting hole, the background art discloses the mixing of gel explosives at the blasting site, as in U.S. Pat. Nos. 3,390,032, issued to Albert on June 25, 1968 and entitled "Gelled Aqueous Slurry Explosive Composition Containing As a Gas Generating Agent a Carbonate or Bicarbonate With a Nitrite"; and U.S. Pat. No. 3,465,675, issued to Bronstein on Sept. 9, 1969 and entitled "Process Of Blasting With Thickened Slurried Inorganic Oxidizer Salt Alcohol, Water Explosive Mixtures." In particular, U.S. Pat. No. 3,465,675 discloses the mixing of a water gel explosive at the blasting site and discloses that the slurry can include an active metal fuel such as aluminum in particulate, granular, atomized or flaked form. Also disclosed therein is that other metal fuels may be used alone or in conjunction with aluminum. These metal fuels include ferrosilicon, magnesium, beryllium and lithium.

While paint grade aluminum has been used in water gel explosive compositions to render them cap sensitive, prior compositions were limited by the maximum achievable sensitivity, rendering them unsuitable for certain important applications. In this regard, it has been difficult to achieve adequate cap sensitivity at temperatures at or below 40° or 50° F. even when up to about 7.5% paint grade aluminum was employed. Additionally, compositions utilizing paint grade aluminum to sensitize water gel explosive compositions often had difficulty in detonating across a three-inch air gap in the standard half cartridge test. This test is required by the Bureau of Mines for explosives which are to be employed in underground coal mining applications. Basically, the test requires that one-half of a cartridge of explosive be able to detonate the second half across an air gap of at least 3 inches.

Water gel cap sensitive explosive compositions have also been sensitized by other materials such as some type of alkyl or alkanol amine nitrate. In order to provide a suitable amine nitrate component in these explosive compositions, highly concentrated aqueous solutions of amine nitrate compositions were required. This sensitizer, although very effective, has the disadvantage of being easily detonated by relatively low mechanical impulses. Thus, preparation of a water gel explosive composition sensitized solely by large amounts of an amine nitrate component can be extremely dangerous unless performed with care. In summary, while it is well known that metals such as aluminum, magnesium and zinc can sensitize water gel explosive compositions if used in a sufficiently fine particle size, the use of ferrophosphorous, ferromanganese, ferrosilicon has not been revealed to sensitize water gel explosive compositions. Ferrophosphorous, ferrosilicon and ferromanganese have been considered in the art to be densifying agents and/or fuels as disclosed in U.S. Pat. No. 3,899,374.

Thus, there has remained a continuing need for a high density small diameter water gel explosive composition which possess good low temperature and air gap sensitivity and which could be manufactured at a reasonable cost. The present invention is addressed to remeding these deficiencies by providing a water gel explosive composition and process for preparing the same which results in significantly greater air gap sensitivity and low temperature detonability.

SUMMARY OF THE INVENTION

According to the present invention, a water gel explosive composition is provided which comprises an oxidizer, water and a gelling agent, and wherein the improvement comprises including therein a sensitizer comprised of from about 1 to about 15 weight percent of aluminum admixed with from about 2 to about 25 weight percent of a densifying agent such as ferrophosphorous, ferromanganese, ferrosilicon, or combinations thereof, said weight percentage based upon a total weight of explosive composition. The water gel explosive composition can also include cross-linkers, inorganic perchlorates, bulking agents, buffers, auxiliary fuels, and auxiliary sensitizers. It has been discovered that water gel explosive compositions may be sensitized by employing a mixture of aluminum with a densifying agent, such as ferrophosphorus, ferrosilicon or other ferro-material or combinations thereof to produce a synergistic increase in low temperature detonability, as well as increased air gap sensitivity.

According to another aspect of the present invention, it has been discovered that the sensitivity can be further increased by premixing the aluminum, preferably paint grade aluminum, with the densifying agent which is preferably finely divided (smaller than 80 mesh U.S. Standard screen) ferrophosphorus, or other densifying agent, to form a sensitizing agent which upon admixture into a water gel explosive composition produces an explosive with improved air-gap sensitivity and low temperature detonability. The present invention is suitable for the manufacture of small diameter (1¼ inch) explosives.

Generally, the sensitizing agent of the present invention can be prepared by admixing from about 3.8 to about 88.2 parts by weight of paint grade aluminum with from about 11.8 to about 96.2 parts by weight of densifying agent. Preferably, the densifying agent is sufficiently finely divided to pass through an 80 mesh (U.S. Standard) screen and the mixture is thoroughly admixed prior to addition to the remaining components of the water gel explosive composition. The sensitizing agent containing aluminum and densifying agent may then be used to sensitize water gel explosive compositions. Such a sensitizing agent can be used either alone or in conjunction with auxiliary sensitizers, such as nitromethane, ethylene diamine dinitrate, nitrate esters, nitroalkanes, amine nitrates.

DETAILED DESCRIPTION

According to the present invention, the combination of aluminum with densifying agents interacts to increase the sensitivity of water gel explosive compositions to achieve low temperature detonability and increased air-gap sensitivity. Water gel explosive compositions normally comprise at least an oxidizer, water, a gelling agent, and a sensitizer. Gel explosives can also contain, bulking agents, fuels, cross-linking agents, buffers and auxiliary sensitizers. The improvement disclosed herein comprises incorporating into such a water gel explosive composition from about 1 to about 15 weight percent of aluminum admixed with from about 2 to about 25 weight percent of densifying agent, said weight percentages based upon the total weight of the explosive composition. The interaction of the two components produces an explosive composition having detonation characteristics unexpectedly greater than when the aluminum or densifying agents are used alone. Surprisingly, mixing the aluminum and densifying agents so that they are intimately admixed prior to addition to the remaining components unexpectedly further increased the low temperature detonability and air gap sensitivity.

According to the preferred embodiment of the present invention, the premixing of the aluminum and densifying agent to form a sensitizing agent further enhances the improved results. The sensitizing agent is formed by admixing from about 1 to about 15 parts by weight of paint grade aluminum with from about 3 to about 25 parts by weight of densifying agent based on the total weight of the compositions. Preferably the sensitizing agent comprises from 1 to about 4% aluminum and from about 10 to about 15% densifying agent based on the total composition. After the sensitizing agent is prepared it is then admixed with the other components to form a water gel explosive composition. The formation of a sensitizing agent by the premixing of the aluminum and densifying agent produces an explosive composition having detonation characteristics unexpectedly greater than when the aluminum and densifying agents are not premixed.

The explosive compositions disclosed herein exhibit improved low temperature sensitivity which enables the explosive compositions to be detonable at temperatures as low as 10° F. An explosive composition having only paint grade aluminum as a sensitizer component and which does not incorporate any densifying agents therewith, is not normally cap sensitive below about 30°-40° F. Therefore, explosive compositions of the type disclosed herein, exhibiting low temperature detonability characteristics, may be effectively used in numerous applications including use in underground mines where low temperatures are often encountered.

The explosive compositions disclosed herein having aluminum admixed with densifying agents, also exhibit improved air-gap sensitivity. Explosive compositions incorporating only paint grade aluminum are generally not detonable across an air-gap of more than about 3 to about 5 inches. The present explosive compositions exhibit increased air-gap sensitivity. When the aluminum and densifying agents are not premixed, water gel explosive compositions can be prepared which are detonable across an 8-inch air-gap. When the aluminum and densifying agents are premixed, in accordance with the preferred embodiment of the invention, before addition to the remaining components of the water gel explosive, the air-gap sensitivity can be further improved such that detonation can be transferred across an air-gap as large as 14 inches. Thus, improved air-gap sensitivity is achievable when explosive compositions are prepared according to the composition and process disclosed herein.

The use of aluminum, magnesium and zinc to sensitize gelled explosive compositions is known in the explosive arts. In particular, the use of finely divided (paint grade) aluminum to sensitize gel explosives is well known. Further, the use of metals for other purposes, such as fuels and densifying agents, is also known. However, it has been found that the combination of aluminum and a densifying agent particularly when the combination is premixed before addition to the remaining components will result in an explosive composition having characteristics superior to those previously known in the art.

One object of the present invention is to provide a sensitizing agent which is an aluminum-densifying agent mixture suitable for sensitizing water gel explosive compositions of the following general formula:

| INGREDIENT | WT. % |
|---|---|
| Inorganic Nitrates | 10–90 |
| Inorganic Perchlorates | 0–50 |
| Bulking Agents | 0–6 |
| Fuels | 0–15 |

-continued

| INGREDIENT | WT. % |
|---|---|
| Auxiliary sensitizers | 0–25 |
| Gelling Agents | 0.2–2.0 |
| Water | 5–25 |
| Aluminum | 1–15 |
| Densifying Agents | 2–25 |

It has been discovered that by admixing aluminum with a densifying agent prior to incorporation into the gelled explosive increased air-gap sensitivity can be achieved.

The sensitizing agent of the present invention can be produced by admixing aluminum with a finely divided densifying agent. In the preferred embodiment of the present invention, aluminum in the form of paint grade aluminum is thoroughly admixed with a particulate densifying agent, sufficiently finely divided so as to pass through an 80 mesh (U.S. Standard) screen. The preferred densifying agent is ferrophosphorus. This material can, however, be replaced, in whole or in part, by other ferro-materials, such ferromanganese or ferrosilicon. In the preferred composition, the sensitizing agent is thoroughly admixed and then incorporated into the water gel explosive composition.

The water gel explosive composition may also contain auxiliary sensitizing agents other than the sensitizing agent of the present invention. These auxiliary sensitizing agents can include, for example, nitromethane, ethylenediamine dinitrate and nitrate esters. Additionally, the water gel explosive composition can also contain aluminum and densifying agents which have not been used in the preparation of the sensitizing agent of the present invention.

Referring to the general formula above, the inorganic nitrates and perchlorates can be salts of ammonia or the alkaline or alkaline earth or Group III elements such as ammonium nitrate, sodium nitrate and sodium perchlorate, for example. Preferably, ammonium nitrate is employed as the main oxidizing agent.

The gelling agent used to gel the aqueous solution may be any of those known to the prior art. The preferred gelling agent is guar gum, such as, Jaguar NG sold by Celanese. Use of other gelling agents, for example, a polyacrylamide, such as, Percol 155 sold by Allied Colloid, may also be used and are sometimes desirable for various reasons. Other examples of gelling agents and gel modifiers include carboxy methyl or ethyl cellulose, biopolymers such as xanthan gum, derivatives of guar gum such as hydroxyethyl or hydroxypropyl guar, synthetic polymers, and polyvinyl alcohols.

Suitable cross-linking agents for the gelling agents include polyvalent metal salts, bromates, chromates, dichromates, antimonates, oxylates, and tartrates. Potassium pryoantimonate is an excellent cross-linking agent. Other examples of cross-linking agents are boric acid and ferric chloride.

Either solid or liquid fuels can be used in the water gel explosive composition of the present invention. Solid fuels may be used and can be of the carbonaceous type such as soft coal or graphite. They can also be chosen from other types of fuels known to the art such as aluminum, ferrophorous or sulfur. Of course, water soluble organic materials such as amides, sugars or alcohols can also be used, for example, ethylene glycol. The gelled explosive composition may also incorporate water insoluble liquid fuels.

Other components can be added to the water gel composition of the present invention such as bulking agents. Bulking agents suitable for use in the present invention include those known in the art, for example, glass microballoons, phenolic microballoons, saran and other resin microballoons, perlite and occluded gas.

EXAMPLES

The following examples are presented in order to better facilitate the understanding of the subject invention but are not intended to limit the scope thereof.

Table I contains a listing of several examples which illustrate the present invention. In general, the mixes were made using the following procedure. First, an oxidizer solution was prepared containing 25% ammonium nitrate, as well as the formula amounts of sodium perchlorate, methylamine nitrate, water and a buffer, monoammonium phosphate/diammonium phosphate 1:1 to maintain the pH in the range of 5.0 to 5.5. Then, the remaining ammonium nitrate was added in ground form, followed by the addition of the guar. The mixture was allowed to hydrate, and then the cross-linking agent in the form of potassium pryoantimonate, such as, Crosslinker RO, sold by Celanese, was added. The final step was the addition of the sensitizing agent of aluminum (in the form of Alcoa 1663) and ferrophosphorus either in a premixed form or merely by being added together without premixing, as indicated in Table I. In the case of Example V, the soft coal was added with the aluminum.

TABLE I

| | COMPOSITIONS OF EXAMPLES (IN PARTS BY WEIGHT) | | | | | | | |
|---|---|---|---|---|---|---|---|---|
| | I. | II. | III. | IV. | V. | VI. | VII. | VIII. |
| Ammonium Nitrate | 68 | 68 | 63 | 63 | 70 | 57 | 62 | 62 |
| Sodium Perchlorate | 5 | 0 | 5 | 5 | 5 | 5 | 5 | 5 |
| Methylamine Nitrate | 0 | 5 | 5 | 5 | 5 | 5 | 5 | 5 |
| Water | 13 | 13 | 13 | 13 | 13 | 13 | 13 | 13 |
| Guar | 0.7 | 0.7 | 0.7 | 0.7 | 0.7 | 0.7 | 0.7 | 0.7 |
| Cross-Linker | 0.015 | 0.015 | 0.02 | 0.02 | 0.02 | 0.02 | 0.02 | 0.02 |
| Buffer | 0.12 | 0.12 | 0.11 | 0.11 | 0.11 | 0.11 | 0.11 | 0.11 |
| Ferrophosphorus | | | | | | | | |
| Ferrophosphorus | 10 | 10 | 10 | 0 | 15 | 10 | 10 | |
| Alcoa 1663 | 3 | 3 | 3 | 3 | 3 | 3 | 4 | 4 |
| Soft Coal | 0 | 0 | 0 | 0 | 2 | 0 | 0 | 0 |
| Al & FeP added together but without premix* | no | no | no | yes | n/a | no | no | yes |
| Premix of Al & FeP | no | no | yes | no | n/a | no | yes | no |

TABLE I-continued

| | COMPOSITIONS OF EXAMPLES (IN PARTS BY WEIGHT) | | | | | | | |
|---|---|---|---|---|---|---|---|---|
| | I. | II. | III. | IV. | V. | VI. | VII. | VIII. |
| Density (g/cc) | 1.35 | 1.35 | 1.44 | 1.41 | 1.34 | 1.46 | 1.35 | 1.35 |

*In these examples the Al and FeP were combined without mixing prior to being added to the remaining components. In contrast, the Al and FeP were separately added to the other components in Examples I, II, and VI.

In all formulations the aluminum was paint grade aluminum in the form of Alcoa 1663 sold by the Aluminum Company of America, and the ferrophorous was sufficiently finely divided so as to pass through a 80 mesh (U.S. Standard) screen.

Examples I and II were prepared in 1,000 gram quantities and packaged in paper cartridges 1¼ inch in diameter by 8 inches in length. Both Examples I and II were detonable at 40° F. even though they were produced at the high densities shown in Table I.

The effect of premixing the aluminum and ferrophosphorus is demonstrated by Examples III, IV, VII, and VIII set forth in Table II. All four of these mixes were made in 130 pound batches. The general procedure outlined above was used to prepare all four; however, Examples III and VII were prepared by premixing the aluminum and ferrophosphorus for 3 minutes in a tumbler before addition to the batch. In Examples IV and VIII, the aluminum and ferrophosphorus were added together but not premixed. All mixes were packed into paper cartridges 1¼ inch in diameter by 8 inches in length. These examples when compared with Example V which contains aluminum but not ferrophosphorus demonstrates the advantages of the present invention.

Table II reports the gap sensitivity and low temperature detonability obtained after allowing the samples to set one week at ambient temperatures (60°-80° F.).

TABLE II

| Example No. | III. | IV. | V. | VI. | VII. | VIII. |
|---|---|---|---|---|---|---|
| Premix of Al—FeP for 3 min. | yes | — | n/a | yes | yes | — |
| Al—FeP added together without premix | — | yes | n/a | — | — | yes |
| Gap (inches) | 12 | 4 | 5 | 6 | 14 | 8 |
| Low Temperature Detonation (degrees F., with No. 6) | 10 | 30 | 20 | 20 | 10 | 10 |

The gap value reported in Table II compares the air-gap sensitivity of each mixture and refers to the air-gap across which the particular formulation will propagate an explosion when packaged in a 1¼ inch by 8 inch paper cartridge and primed with a No. 6 cap. The low temperature values report the lowest temperature at which a 1¼ inch by 8 inch paper cartridge of the particular formulation would detonate when primed with a No. 6 cap after approximately 2 months of storage.

Comparison of Example III with IV and also Example VII with VIII clearly demonstrates the improvement in both air-gap sensitivity and low temperature detonability which can be obtained by premixing the aluminum with the densifier.

Example V when compared to III demonstrates the improved air-gap sensitivity and low temperature detonability obtainable with the present invention as compared to the use of other fuels. In addition, such a comparison reveals that this greater air-gap sensitivity is also accompanied by a significantly higher density.

Formulations of Examples V and III were prepared in 1¼ inch by 8 inch paper cartridges and they were tested after two months of storage. Upon testing, it was found that Example III was detonable at 30° F. when primed with a No. 6 cap while Example V failed to detonate at 50° F. or below.

Example VI was included to demonstrate the densities obtainable with explosive compositions of the present invention. Example VI was prepared by premixing the aluminum and ferrophosphorus for 3 minutes in a tumbler before addition to the batch. When the gelled explosive composition of Example VI was packaged in 1¼ inch by 8 inch paper cartridges, it was found to be detonable at 20° F. with a No. 6 cap, and to be able to propagate across an air-gap of 6 inches.

While this invention has been described in relation to its preferred embodiments, it is to be understood that various modifications thereof will be apparent to those of ordinary skill in the art upon reading the specification and it is intended to cover all such modifications as fall within the scope of the appended claims.

I claim:

1. In a water gel explosive composition comprising inorganic oxidizing agents, water, and gelling agents, the improvement comprising including therein:

a sensitizing agent comprising a mixture of aluminum and a densifying agent, said mixture being admixed prior to incorporation into the water gel explosive composition.

2. The explosive composition of claim 1 wherein said sensitizing agent contains from about 3.8 to 88.2 parts by weight of aluminum and from about 11.8 to 96.2 parts by weight of densifying agent.

3. The explosive composition of claim 1 wherein said aluminum is paint grade aluminum.

4. The explosive composition of claim 1, 2, or 3 wherein said densifying agent is selected from the group consisting of ferrophosphorus, ferrosilicon, ferromanganese or combinations thereof.

5. The explosive composition of claim 1 wherein:

(a) said aluminum is paint grade aluminum, (b) wherein said densifying agent is selected from the group consisting of ferrophosphorus, ferrosilicon, ferromanganese or combinations thereof, (c) said densifying agent being sufficiently finely divided to pass through an 80 mesh U.S. Standard screen, and (d) said sensitizing agent is thoroughly admixed prior to addition of said sensitizing agent to the other components for a period of time sufficient to intimately intermix said aluminum and said densifying agent.

6. The explosive composition of claim 1 wherein said inorganic oxidizing agent comprises ammonium nitrate and a member selected from the group consisting of sodium nitrate, sodium perchlorate and mixtures thereof.

7. The explosive composition of claim 1 wherein said gelling agent is selected from the group consisting of guar gum, chemically modified guar gum, carboxy methyl cellulose, methyl cellulose, synthetic polymers, polyacrylamides and polyvinyl alcohols.

8. The explosive composition of claim 1 wherein the gelling agent is guar gum.

9. The explosive composition of claim 1 and further comprising a cross-linking agent selected from the group consisting of metal salts of borates, chromates, dichromates, antimonates, tartrates, and oxylates.

10. The explosive composition of claim 9 wherein said cross-linking agent is potassium pryoantimonate.

11. A water gel explosive composition comprising:

(a) from about 10 to about 90 weight percent organic oxidizer;

(b) from about 5 to about 25 weight percent water;

(c) from about 3 to about 40 weight percent of a sensitizing agent comprising from about 1 to about 15 weight percent of aluminum based on the total composition and from about 2 to about 25 weight percent of a densifying agent based on the total weight of the composition;

(d) from about 0.2 to about 2 weight percent gelling agent;

(e) from about 0 to about 25 weight percent of auxiliary sensitizers;

(f) from about 0 to about 50 weight percent inorganic perchlorates; and (g) from about 0 to about 6 weight percent bulking agents;

12. The explosive composition of claim 11 wherein said aluminum is paint grade aluminum.

13. The composition of claim 11 wherein said densifying agent is ferrophosphorus, ferrosilicon, ferromagnese or a combination thereof.

14. The composition of claim 13 wherein said densifying agent is sufficiently finely divided so as to pass through an 80 mesh (U.S. Standard) screen.

15. The composition of claim 11 wherein said bulking agent is selected from the group consisting of glass microbubbles, resin microbubbles, perchlorate, and drain gas and mixtures thereof.

16. The composition of claim 11 wherein said auxiliary sensitizer is methyl amine nitrate.

17. The composition of claim 11 wherein said gelling agent is selected from the group consisting of guar gum, chemically modified guar gum, carboxyl methyl cellulose, methyl cellulose, synthetic polymers, polymer acrylic and polyvinyl alcohols.

18. The composition of claim 11 and further comprising a cross linking agent selected from the group consisting of metal salts of chromates, chromates, dichromates, and, tartates, and oxylates.

19. The product of claim 11 wherein said inorganic oxidizer is selected from the group consisting of ammonium nitrate, sodium nitrate, or combinations thereof.

20. The product of claim 11 wherein said inorganic perchlorates are selected from the group consisting of perchlorates of ammonia or the alkaline or alkaline earth or group three elements.

21. A process of producing an improved water gel explosive composition of the following formula:

| INGREDIENT | % BY WEIGHT |
|---|---|
| Inorganic Nitrates | 10–90 |
| Inorganic Perchlorates | 0–50 |
| Bulking Agents | 0–6 |
| Fuels | 0–15 |
| Gelling Agents | 0.2–2.0 |
| Axuiliary Sensitizers | 0–25 |
| Water | 5–25 |
| Aluminum | 1–15 |
| Densifying Agent | 2–25 |

the improvement comprising (a) first forming a sensitizing agent by admixing said aluminum and said densifying agent and (b) thereafter adding said sensitizing agent to the remaining ingredients.

22. The process of claim 21 wherein said densifying agent is ferrophosphorus, ferrosilicon, ferromanganese or combinations thereof.

23. The process of claim 22 wherein said aluminum is a paint grade aluminum.

24. The process of claim 23 wherein said aluminum is present in a concentration in an amount from 1 to about 4% by weight and wherein said densifying agents are present in an amount from about 10 to about 15% by weight based on the weight of the water gel explosive composition.

25. The process of claim 22 wherein said bulking agent is selected from the group consisting of glass microbubbles, resin microballoons, perlite, entrained gas and mixtures thereof.

26. The process of claim 22 wherein auxiliary sensitizer is methylamine nitrate.

27. The process of claim 22 wherein said gelling agent is selected from the group consisting of guar gum, chemically modified guar gum, carboxy methyl cellulose, methyl cellulose, synthetic polymers, polyacrylamides and polyvinyl alcohols.

28. The process of claim 22 wherein said densifying agent is in particulate form sufficiently finely divided to pass through an 80 mesh U.S. Standard screen and wherein said aluminum is paint grade aluminum.

29. The process of claim 22 and further comprising admixing a cross-linking agent therewith, wherein said cross-linking agent is selected from the group consisting of metal salts of bromates, chromates, dichromates, antimonates, tartrates, and oxylates.

30. The process of claim 22 wherein the cross-linking agent is potassium pryoantimonate.

* * * * *

UNITED STATES PATENT AND TRADEMARK OFFICE

CERTIFICATE OF CORRECTION

PATENT NO. : 4,439,254

DATED : March 27, 1984

INVENTOR(S) : John J. Mullay

It is certified that error appears in the above—identified patent and that said Letters Patent is hereby corrected as shown below:

Column 6, line 62, delete first Ferrophosphorus;

Column 6, line 63, Table I, under Table Heading IV, delete "0" and insert --10--;

Under Table Heading V, delete "15" and insert --0--;

Under Table Heading VI, delete "10" and insert --15--;

Under Table Heading VIII, insert --10--.

Column 9, line 59, "tartates" should be "tartrates."

Column 10, line 17, "Axuiliary" should be "Auxiliary."

Signed and Sealed this

Fourth Day of September 1984

[SEAL]

*Attest:*

GERALD J. MOSSINGHOFF

*Attesting Officer*

*Commissioner of Patents and Trademarks*